US005350066A

United States Patent [19]

Mendoza et al.

[11] Patent Number: 5,350,066

[45] Date of Patent: Sep. 27, 1994

[54] CORRUGATED PALLET AND CONTAINER SYSTEM

[75] Inventors: Ramon C. Mendoza, Moline, Ill.; Michael J. Vonderhaar, Davenport, Iowa

[73] Assignees: Deere & Company, Moline; Miller Container Corp., Rock Island, both of Ill.

[21] Appl. No.: 138,171

[22] Filed: Oct. 15, 1993

[51] Int. Cl.[5] ..... B65D 19/20

[52] U.S. Cl. ..... 206/386; 206/599; 108/51.3

[58] Field of Search ..... 206/386, 596, 598, 599, 206/600; 229/DIG. 4; 108/51.3; 248/174

[56] References Cited

U.S. PATENT DOCUMENTS

| | | | |
|---|---|---|---|
| 2,894,571 | 7/1959 | Nicholls . | |
| 2,902,199 | 9/1959 | Breton . | |
| 2,996,276 | 8/1961 | Sorensen et al. . | |
| 3,464,371 | 9/1969 | Gifford | 108/51.3 |
| 3,587,479 | 6/1971 | Geschwender . | |
| 3,659,534 | 5/1972 | Childs | 108/51.3 X |
| 3,708,861 | 1/1973 | Hickey . | |
| 3,940,101 | 2/1976 | Heidelbach . | |
| 3,952,672 | 4/1976 | Gordon et al. | 108/51.3 X |
| 3,995,736 | 12/1976 | Lawson . | |
| 4,383,609 | 5/1983 | Lochmiller . | |
| 4,759,295 | 7/1988 | Nilsen et al. | 248/174 X |
| 4,790,249 | 12/1988 | Webb | 206/599 X |
| 4,863,024 | 9/1989 | Booth . | |
| 4,927,026 | 5/1990 | Gossler et al. . | |
| 4,949,898 | 8/1990 | Nederveld . | |
| 4,979,446 | 12/1990 | Winebarger . | |
| 5,110,037 | 5/1992 | Pieritz, Sr. . | |

*Primary Examiner*—Jacob K. Ackun, Jr.

[57] ABSTRACT

A palletized container system including deck and runner structure formed from a unitary deck sheet of corrugated material having top and bottom generally planar surfaces and opposite parallel sides. The deck sheet is folded downwardly and then upwardly at each of its sides to form fore-and-aft extending outer runners unitary with the remainder of the sheet to provide outer runner lateral stability. An elongated central runner is fixed to the bottom of the sheet and extends parallel to the outer runners. A corrugated wrapper extends under the central and side runners and is folded around the side runners and over the deck sheet. The wrapper has upper planar portions extending inwardly from the side portions of the side runners toward the central runner and fixed to the top planar surface. A one-piece liner board is fixed to the upper planar portions of the wrapper to increase strength and includes flaps folded upwardly to slidably receive an open bottom container.

17 Claims, 2 Drawing Sheets

10
58
60
56
50
48
46
42
56
58
50
50
60
46
48
50
38
36
14
34
101
36
40
38
26
12
102
100
94A
101
98
102
18
108
28
96
16
108
92
94B
22
94
28
18
100
98

CORRUGATED PALLET AND CONTAINER SYSTEM

BACKGROUND OF THE INVENTION

1) Field of the Invention

The present invention relates generally to pallets and containers and, more specifically, to an improved corrugated pallet and container construction for use with a forklift truck or jack truck.

2) Related Art

Containers connected to or placed upon pallets are commonly used to transport items. Forklift or jack trucks move the pallets and containers, and it is necessary that the containers fit squarely on the pallets. A typical construction includes a wooden pallet with a portion of the container nailed or stapled to the upper deck of the pallet. Assembly of the pallet and container is usually time consuming and awkward. The wooden pallets, although strong and easily stackable, are heavy and bulky, relatively expensive, and a problem to transport or recycle after use. Replacing a container when the original is worn or otherwise damaged is also very difficult.

Various designs for non-wood pallets and non-wood palletized container systems have been proposed in the past, examples of which are shown in U.S. Pat. Nos. 3,587,479; 3,940,101; 4,863,024; and 4,979,446. Most of the non-wood pallets have suffered from one or more serious shortcomings. Some have very complicated construction and often are expensive and difficult to set up. Non-wood pallets are often not very strong and are particularly susceptible to sideways movements which can collapse the runners or actually separate a runner from the remainder of the pallet and container system. If a lift truck fork happens to contact one or more of the runners at a wrong angle or with too much force, the pallet can collapse or otherwise be damaged to the point it is unusable. Some palletized containers with non-wood pallets cannot be stacked as conveniently and securely as those with wooden pallets, and therefore the payloads often have to be reduced. A few of the container systems with non-wood pallets which were adequate for use with forklift trucks proved to be unsatisfactory for jack trucks which have wheels or rollers at the end of the forks for stabilization.

BRIEF SUMMARY OF THE INVENTION

It is therefore an object of the present invention to provide an improved pallet which overcomes most or all of the above-mentioned problems. It is a further object to provide such an improved pallet and container combination.

It is a further object of the present invention to provide an improved pallet constructed of corrugated material and having increased strength and improved runners with increased lateral stability. It is a further object to provide such a pallet which is relatively simple and inexpensive in construction.

It is still another object of the present invention to provide a palletized container system which is inexpensive, easy to recycle, light in weight but strong and able to withstand impact and side loads without collapsing the runners or otherwise rendering the system unusable.

A palletized container system includes deck and runner structure formed from a unitary deck sheet of corrugated fiber material having top and bottom generally planar surfaces and opposite parallel sides. The deck sheet is folded downwardly and then upwardly at each of its sides to form fore-and-aft extending outer runners unitary with the remainder of the sheet to provide outer runner lateral stability. Central runner structure is fixed to the bottom of the sheet and extends parallel to the outer runners. A corrugated wrapper extends under the central and side runners and is folded around the side runners and over the deck sheet. The wrapper has upper planar portions extending inwardly from the side portions of the side runners toward the central runner and fixed to the top planar surface. A one-piece liner board is fixed to the upper planar portions of the wrapper to increase pallet strength and includes flaps folded upwardly to slidably receive an open bottom container. The container structure is easy to assemble and disassemble, and is strong and resistant to breakout.

The palletized container system is relatively light in weight, strong, and resistant to sideways collapsing of the runners. The corrugated construction is easy to recycle and eliminates need for wooden slats or stapling. Conventional pallet sizes can be constructed and loads comparable to those carried by heavier wooden pallets can be accommodated. The palletized containers can be handled and stacked in a manner substantially identical to that used with previous pallets. The unique corrugated construction lends itself to fast automated manufacturing techniques.

These and other objects, features and advantages of the present invention will become apparent to one skilled in the art upon reading the following detailed description in view of the drawings.

DETAILED DESCRIPTION OF THE DRAWINGS

Figure 1:
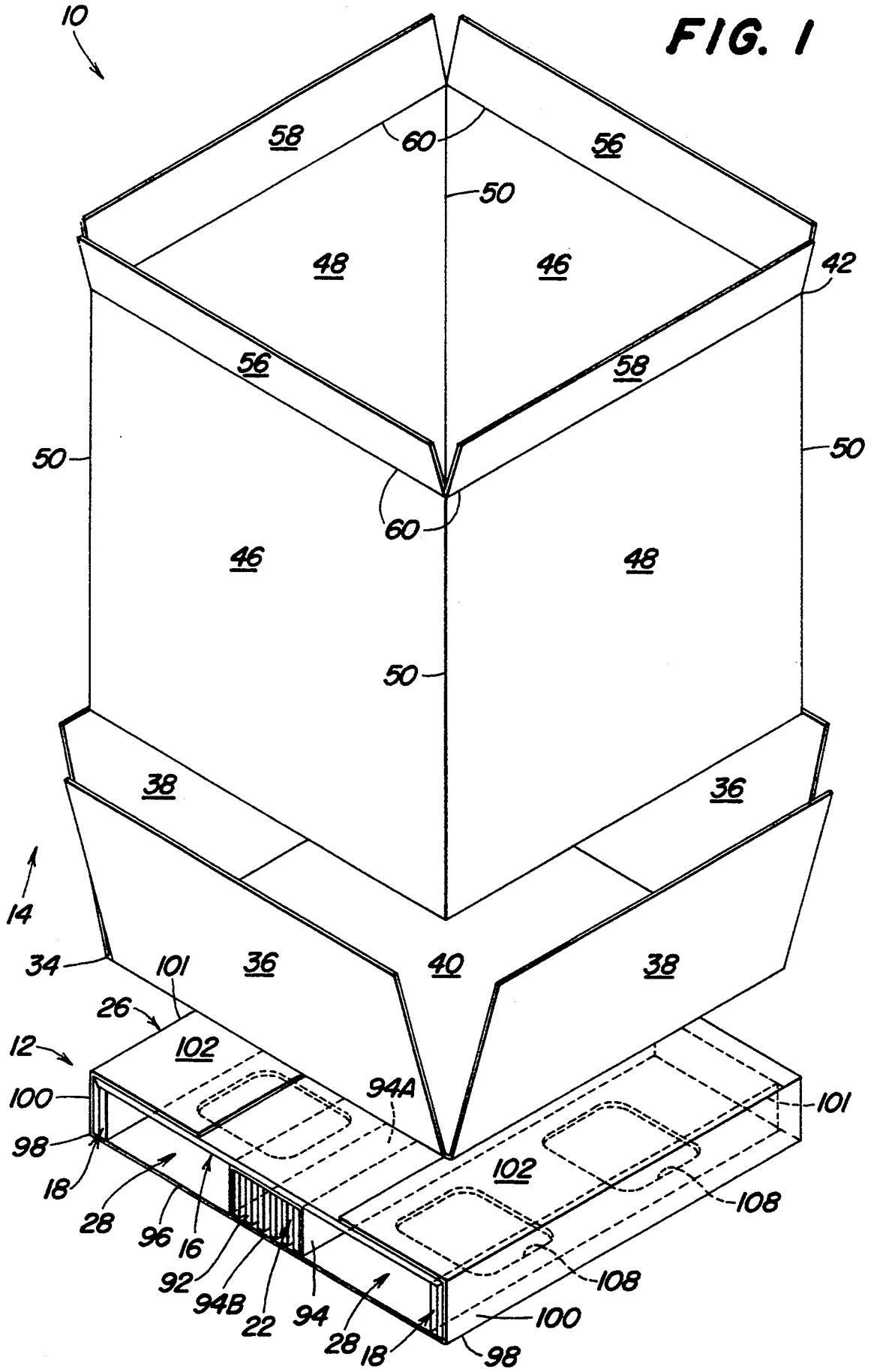
FIG. 1 is an exploded view of a palletized container system constructed in accordance with the teachings of the present invention.

Referring now to FIG. 1, therein is shown a palletized container system 10 including a pallet assembly 12 and a container assembly 14. The pallet assembly 12 includes a deck member 16 with integral outer runners 18, and a central runner 22. A wrapper 26 extends completely around the runners 18 and over the top of the deck member 16. Fore-and-aft extending fork-receiving spaces are defined between the central runner 22 and the side runners 18 in the areas between the top and bottom of the wrapper 26.

The container assembly 14 includes a liner or bottom sheet 34 with opposite end flaps 36 and opposed side flaps 38. The sheet 34 has a rectangular bottom area 40 which substantially conforms to the shape of the top of the pallet 12. The assembly 14 also includes an open-bottomed foldable box blank 42 having end walls 46 and side walls 48 joined at vertical fold lines indicated generally at 50. The shape of the box blank 42 bottom opening conforms to the rectangular shape of the sheet bottom area 40 so the flaps 36 and 38 provide a snug fit against the inner sides of the walls 46 and 48 when the blank 42 is placed over the flaps during assembly. Narrow, reinforcing flaps 56 and 58 are located at the upper ends of the walls 46 and 48, respectively, and are foldable inwardly about generally horizontal fold lines 60 for strengthening the top edge of the container.

Figure 2:
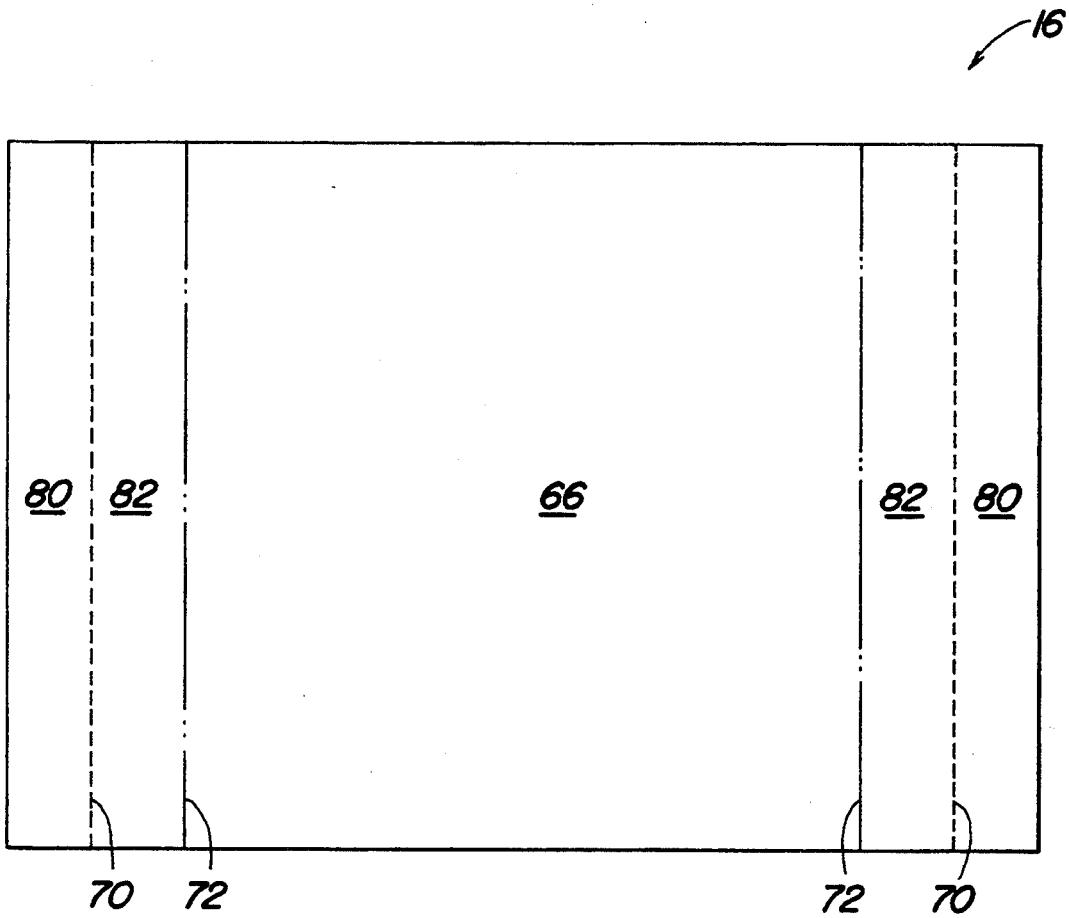
FIG. 2 is a top view of the deck sheet utilized with the container system of FIG. 1.
Figure 3:
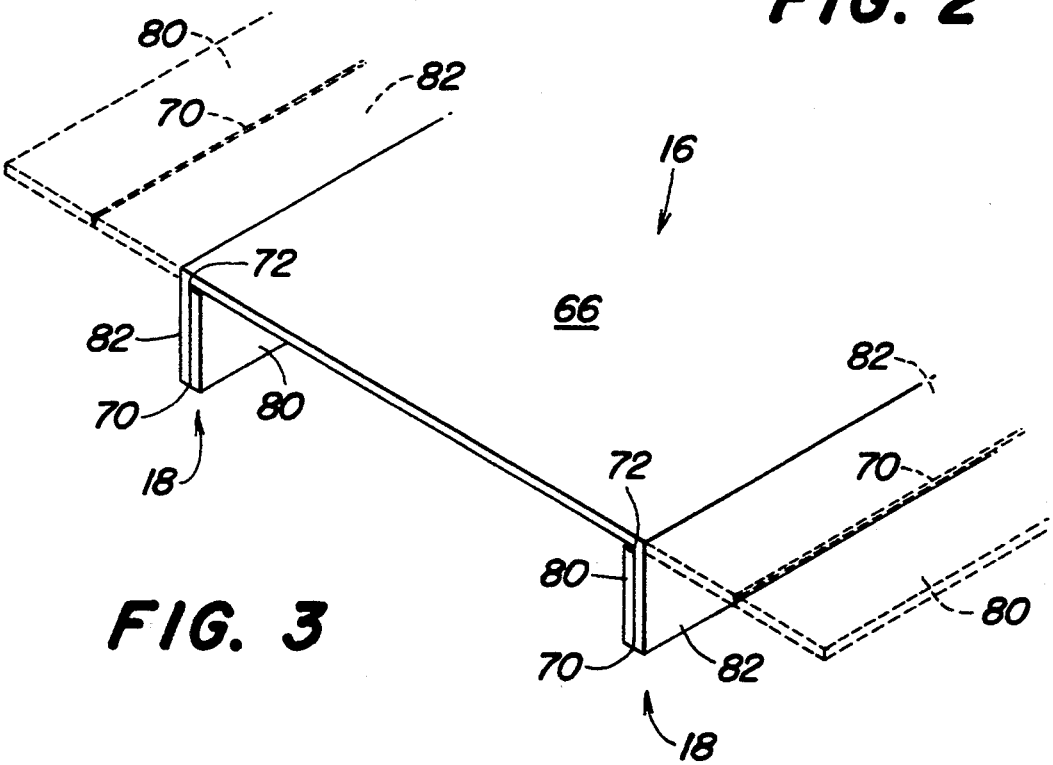
FIG. 3 is a perspective view of the deck sheet of FIG. 2 showing end panels prior to folding (broken lines) and after folding (solid lines) to provide the outer runners for the container system.

As best seen in FIGS. 2 and 3, the deck member 16 is fabricated from a rectangular sheet 66 of corrugated material. An outermost cut-scored fold line 70 extends parallel to each outer edge on the upper side of the deck sheet 66 and is offset inwardly from the outer edge a distance of approximately the height of the fork-receiving spaces 28. An inner scored fold line 72 on the under side of the deck sheet extends parallel to each fold line 70. The fold lines 70 and 72 define outer and inner runner panels indicated at 80 and 82. The outer panel 80 is folded downwardly about the cut-scored fold line 70 against the lower surface of the inner panel 82, and the outer panel 80 is secured to the lower panel 82. Preferably, glue is applied to the lower surfaces of the panels 80 and 82 to bond the panels and form the runners 18 with strong double thickness of corrugated material. Each double panel area is folded 90 degrees downwardly from the plane of the remainder of the deck sheet about the lightly scored fold line 72 (FIG. 3). The scoring of the bottom of the sheet at 72 and of the top side of the deck sheet at 70 to retain an integral single sheet construction adds to the combined integrity of the panels 80 and 82 and to the overall integrity of the combination of the runners 18 with the remainder of the deck sheet 66.

As shown in FIG. 1, the central runner 22 includes a honeycomb core 92 wrapped with a corrugated sheet 94 to form an elongated member of rectangular cross section. The runner 22, which is parallel to the runners 18, includes an upper panel 94A fixed to the lower surface of the deck member 16 between the runners 18. The wrapper 26 includes a bottom panel 96 extending between the runners 18. The bottom panel 94B of the core wrap sheet 94 is glued at a central location to the sheet bottom panel 96. At bend locations 98, the wrapper 26 extends upwardly adjacent the panels 82 to define wrapper side walls 100. The wrapper 26 extends inwardly at bend locations 101 to define two panels 102 which extend over a portion of the top of the deck member 16 towards the central runner 22. The side walls 100 preferably are glued to runners 18, and the upper panels 102 are glued to the top of the deck member 16. The panels 102 as shown terminate outwardly of the central runner 22 to reduce the amount of corrugated material required for the pallet assembly 12. Apertures 10S are cut out of the pallet bottom panel 96 to accommodate the wheels or rollers of jack trucks.

The bottom area 40 of the liner sheet 34 is secured to the upper surfaces of the upper panels 102, preferably by gluing, to fix the liner sheet 34 relative to the pallet structure and to increase the strength and integrity of the pallet assembly 12. The flaps 36 and 38 are folded upwardly and inwardly toward each other so the box blank 42 can be easily positioned around the flaps. Once the box blank 42 is pushed down over the flaps 36 and 38, the flaps are pushed outwardly against the end and side walls 46 and 48. The container construction described above with the integral flaps 36 and 38 can be easily and quickly assembled and disassembled, is resistant to breakout, and provides good load support in all directions with a minimum amount of corrugated material. The pallet construction lends itself well to automated folding and gluing techniques.

By way of example only, the deck member 16 is preferably fabricated from triple wall corrugated 900# material. The wrapper 26 is formed from double wall corrugated 350# material. The container bottom sheet 34 is preferably single wall corrugated 275# material. The wrapped core 92 is commercially available from Hexacomb International. The runners 18 have a thickness at least twice the thickness of the wrapper 26.

Having described the preferred embodiment, it will become apparent that various modifications can be made without departing from the scope of the invention as defined in the accompanying claims.

We claim:

1. A pallet component adapted for receipt of and movement by the forks of a fork pallet truck, the pallet component comprising:

a unitary sheet of corrugated material having top and bottom generally planar surfaces and opposed parallel sides, inner and outer panels defined at each of said opposed parallel sides by fore-and-aft extending inner and outer fold lines running parallel to the sides, said inner and outer panels folded together about each of said outer fold lines into facing contact with each other, the folded together inner and outer panels folded downwardly along each of said inner fold lines to form fore-and-aft extending outer or side runners unitary with the remainder of the sheet to provide outer runner lateral stability;

a central runner fixed to the bottom of the sheet generally parallel to said outer runners to define with the outer runners fore-and-aft extending fork receiving areas; and a wrapper extending under the central and side runners, the wrapper folded around the side runners about fold lines parallel to the side runners so that the side runners are surrounded on their bottom, side and top portions, the wrapper having upper planar portions extending inwardly from the side portions of the side runners toward the central runner, wherein the wrapper extends inwardly toward the central runner and is fixed to the top planar surface to provide lateral stability to the side runners.

2. The pallet component as set forth in claim 1 wherein the wrapper comprises corrugated material of preselected thickness, wherein the side runners have a combined thickness at least twice as great as said preselected thickness.

3. The pallet component as set forth in claim 1 including a top member fixed to the upper planar portions and extending over the central runner.

4. The pallet component as set forth in claim 1 wherein the pallet wrapper comprises a single piece of corrugated material forming a continuous wrap under the side and central runners and around the side runners.

5. The pallet component as set forth in claim 4 wherein the wrapper has opposite edges offset from each other on opposite sides of the central runner at the top planar surface, and further including a carton bottom piece fixed to the top of the wrapper and providing reinforcement to the pallet component.

6. The pallet component as set forth in claim 1 wherein the fold lines define inner and outer panels of generally equivalent width at each side of the sheet.

7. The pallet component as set forth in claim 6 wherein the outer fold lines are cut scored and the inner and outer panels at each side are folded against each other about the outer fold lines.

8. The pallet component as set forth in claim 1 further comprising a top member fixed to the upper planar portions of the pallet wrapper, the top member providing reinforcement to the upper planar portions.

9. The pallet component as set forth in claim 8 wherein the top member includes flaps adapted for folding upwardly.

10. The pallet component as set forth in claim 9 further comprising a container portion having an open bottom, wherein the container portion is slidably received over the upwardly folded flaps to define with the top member a closed container secured to the wrapper.

11. The pallet component as set forth in claim 6 wherein each inner panel is glued to the adjacent outer panel, and wherein the wrapper is glued to the side runners.

12. A corrugated fiber pallet comprising a deck sheet of rectangular configuration and preselected thickness, the sheet having opposed sides and first and second fold lines at each side, the fold lines extending in the fore-and-aft direction to define first and second narrow parallel panels, the first panel folded about the first fold line to a position against the second panel, the first and second panels folded about the second fold line approximately 90 degrees from the plane of the remainder of the sheet to define an upper deck portion with a downwardly projecting side runner at each side of the deck portion, the side runners having a width at least approximately twice the preselected thickness, a central runner attached to a bottom of said upper deck portion, a wrapper of corrugated material extending under the side and central runners and around and over the side runners into the deck portion, and wherein the wrapper is secured to the side and central runners and to the deck portion between the runners.

13. The corrugated fiber pallet as set forth in claim 12 further comprising a top sheet fixed to the deck portion.

14. The corrugated fiber pallet as set forth in claim 13 wherein the top sheet comprises a unitary corrugated sheet defining a container bottom section.

15. The corrugated fiber pallet as set forth in claim 14 wherein the unitary corrugated sheet includes a bottom panel conforming to the shape of the deck portion and foldable side flaps extending outwardly from the bottom panel and adapted for folding upwardly to receive a container thereon.

16. The corrugated fiber pallet as set forth in claim 12 wherein the wrapper comprises a double wall corrugated fiber sheet and the deck sheet comprises a triple wall corrugated fiber sheet.

17. The corrugated fiber pallet as set forth in claim 12 wherein the first and second panels include adjacent faces, the adjacent faces glued to each other, and wherein the wrapper is glued to the central and side runners and to the deck portion.

* * * * *